United States Patent [19]

Paul

[11] 4,192,239

[45] Mar. 11, 1980

[54] SERIES PNEUMATIC AND COIL SPRING RAILWAY CAR SUSPENSION

[75] Inventor: John M. Paul, Holland, Pa.

[73] Assignee: The Budd Company, Troy, Mich.

[21] Appl. No.: 866,483

[22] Filed: Jan. 3, 1978

[51] Int. Cl.[2] ..... B61F 3/04; B61F 5/06; B61F 5/10; B61F 5/52

[52] U.S. Cl. ..... 105/199 R; 105/109; 105/117; 105/182 R; 105/197 B; 105/200; 267/3

[58] Field of Search ..... 105/108, 133, 171, 182 R, 105/197 B, 199 R, 200, 109, 117, 130, 131, 132, 132.1, 135; 267/3; 308/138

[56] References Cited

U.S. PATENT DOCUMENTS

| | | | |
|---|---|---|---|
| 3,361,087 | 1/1968 | Dean | 267/3 X |
| 4,029,021 | 6/1977 | Paul | 267/3 X |

*Primary Examiner*—Joseph F. Peters, Jr.
*Assistant Examiner*—Howard Beltran
*Attorney, Agent, or Firm*—A. L. Trueax, Jr.

[57] ABSTRACT

A pair of mechanical springs are disposed on an air spring on each side of a truck carrying a car body. A wide plank disposed between the pairs of mechanical springs and each of the air springs is pivoted to permit vertical movements without tilting of the air springs when the mechanical springs are deflected laterally. Shock absorber means are connected between the car body and bolster along the longitudinal axis of the bolster to control lateral shocks as when the mechanical springs are laterally deflected.

Mechanical springs in railway cars have employed pairs of mechanical springs in series with pneumatic springs. Multiple mechanical springs, in series with pneumatic springs, have included a heavy outer coil spring and an inner lighter coil spring coaxially nested with the heavy outer spring used to keep the stress levels on the individual springs relatively low. This arrangement is illustrated in U.S. Pat. 3,491,702 to A. G. Dean entitled "Series Pneumatic and Coil Spring Assembly". The series mechanical and air spring are desirable because the mechanical spring will still give support for the car if the air spring fails.

7 Claims, 5 Drawing Figures

SERIES PNEUMATIC AND COIL SPRING RAILWAY CAR SUSPENSION

Multiple springs having a number of rows and columns have been used in freight cars. Springs have been added or substracted to obtain the desired vertical spring rates. Lateral spring rates are of secondary consideration in these applications.

Large mechanical springs, which generally must be of the same diameter as the air spring, have a number of disadvantages. A large diameter mechanical spring produces a harder lateral spring rate than springs of smaller diameters. However, single smaller springs are not capable of supporting the car body. Also large diameter springs are heavy and tend to put high stress loads on the bolster. In addition, such large springs require much space in areas where other elements, such as cables, conduits and the like, may be mounted.

A multiple mechanical spring arrangement, in which the springs are disposed laterally, still have relatively high lateral spring rates.

Lateral absorbers must be designed in conjunction with the lateral spring rates of the mechanical springs. Shock absorbers that control the lateral shocks when the mechanical springs are deflected are also well known. Those shock absorbers are designed to dampen the lateral movements of the car body with respect to the trucks. During these lateral movements, the associated mechanical springs are deflected laterally. In the past, these lateral shock absorbers have been connected between the car body and bolster on opposite sides of the bolster away from its longitudinal axis.

While the above arrangement regarding shock absorbers is satisfactory during normal operation, failure of one of the shock absorbers causes problems. For example, if only one shock absorber is operating properly, the lateral force exerted by the remaining one will tend to be out of equilibrium and cause the damping to be ineffective in the desired lateral direction. Also, shock absorbers used in conjunction with springs having high lateral spring rates are generally larger, heavier and take up more room than those designed for use with springs having lower lateral spring rates.

In designing a system in which low lateral mechanical spring rates and the springs are used in series with air springs, it is important that the lower spring rates do not cause the air springs to tilt. The air springs must still deflect vertically. While such means for accomplishing this is known per se, such means become especially important when the low lateral spring rates of the present invention are employed.

It is an object of this invention to provide an improved lateral spring and shock system for a railway car.

It is a further object of this invention to provide an improved mechanical spring system for a railway car with improved lateral spring characteristics.

It is still a further object of this invention to provide an improved mechanical spring system for a railway car in which space requirements are minimized.

It is still a further object of this invention to provide an improved lateral shock absorber system involving shock absorber means in which a balanced system is provided.

It is still a further object of this invention to provide an arrangement in which a low lateral spring rate is provided in series with a pneumatic spring which is maintained operative substantially only in vertical directions.

In accordance with the present invention, a system for supporting a car body includes a truck assembly having a pair of longitudinally disposed parallel side frames. A pair of mechanical springs are serially connected to an air spring on each of the side frames, with lateral shock absorber means being connected horizontally between the car body and the bolster. The shock absorber means are disposed along the longitudinal axis of said bolster. The mechanical springs are disposed longitudinally with respect to the truck to be tilted laterally and the shock absorbers actuated during lateral movements of the car body with respect to the truck. Means are provided to maintain the vertical deflections of the air springs when the mechanical springs are tilted.

The drawings in this application are identical to those disclosed in a copending application entitled "A Drive System for a Railway Car", Ser. No. 886,484, filed Jan. 3, 1978, and assigned to the same assignee as the present invention.

Other objects and advantages of the present invention will be apparent and suggest themselves to those skilled in the art from a reading of the following specification and claims, taken in conjunction with the accompanying drawings, in which:

Figure 1:
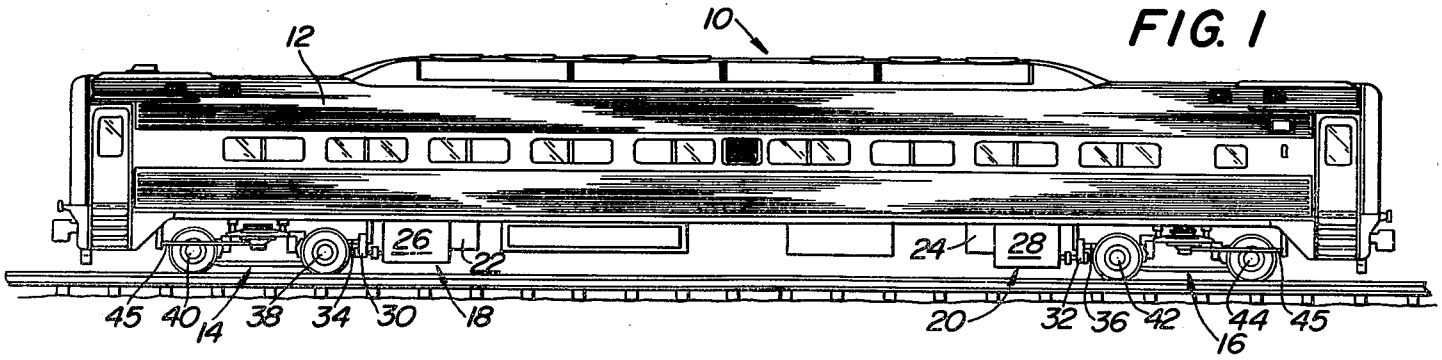
FIG. 1 is a side view of a railway car including the driving mechanisms and trucks illustrated to show the general environment of the present invention.

Referring particularly to FIG. 1, a railway car 10 includes a car body 12 mounted on a pair of trucks 14 and 16. A pair of driving means 18 and 20 are connected to drive mechanisms on the trucks 14 and 16, respectively. The driving means 18 and 20 may include a pair of prime movers, such as diesel engines 22 and 24, respectively. The outputs from the diesel engines 22 and 24 are applied to a pair of torque converters 26 and 28 with the torque converters 26 and 28 being connected to a pair of transmission gear boxes 30 and 32, respectively.

Output shafts 34 and 36 connect the driving means 18 and 20 to apparatus on the trucks 14 and 16 to drive the axles, such as the axles 38 and 40 and 42 and 44. Anchor rods or stay bars 43 and 45 are connected between the car body and bolster in a well known manner.

As is well known, during operation, the car body will move vertically and laterally with respect to the trucks. Various springs and shock absorbers are used to keep these movements within acceptable limits to add to the general comfort of a passenger.

Figure 2:
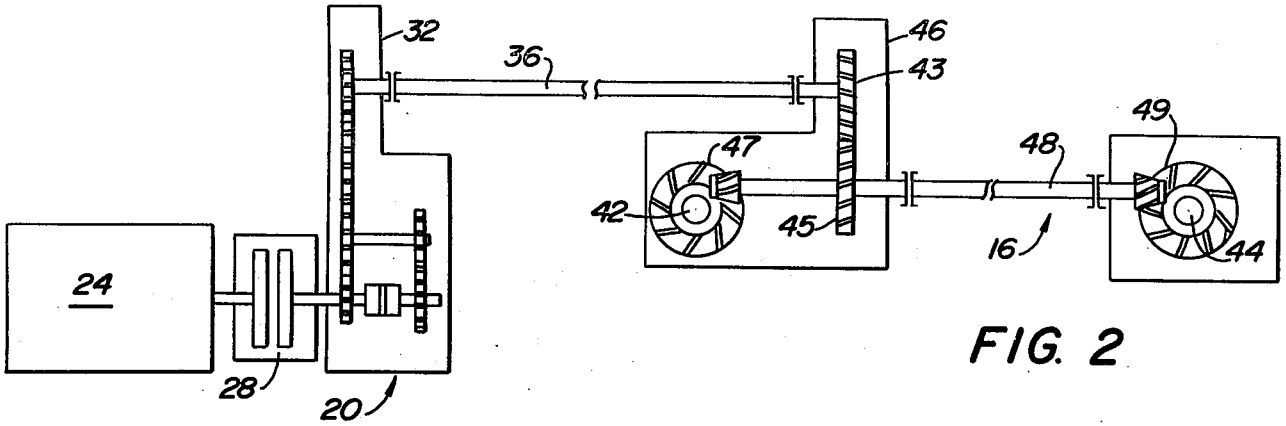
FIG. 2 is a schematic representation of a drive system which may be used in the railway car illustrated in FIG. 1.

Referring particularly to FIG. 2, the prime mover 24, which may be a diesel engine, is connected to a torque converter 28 which may be of the hydraulic type, which is connected to drive the transmission gear box 32. The output shaft 36 connects the transmission gear box 36 with its multiple gear arrangement to an interchangeable gear speed control mechanism 46. The gear mechanism 46 may include a pair of gears 43 and 45. The gear 45 is connected to drive a bevel gear train 47 and the axle 42. A drive shaft 48 is connected from the gear 45 of the gear mechanism 46 to the bevel gears 49 to drive the axle 44.

References to FIGS. 1 and 2 are made only for the purposes of illustrating the general environment which may help in understanding the advantages of the present invention.

Figure 3:
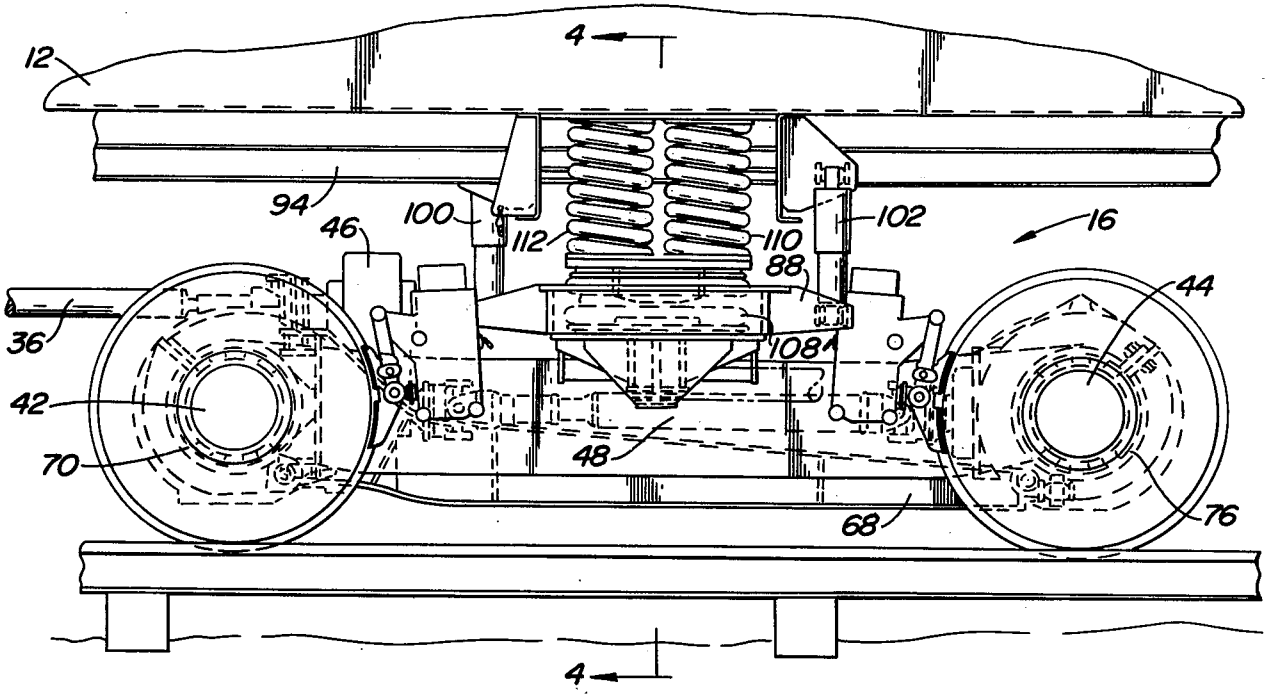
FIG. 3 is a side view of one of the trucks supporting the car body of FIG. 1 which incorporates the mechanical spring, pneumatic spring and shock absorber arrangement of the present invention.
Figure 4:
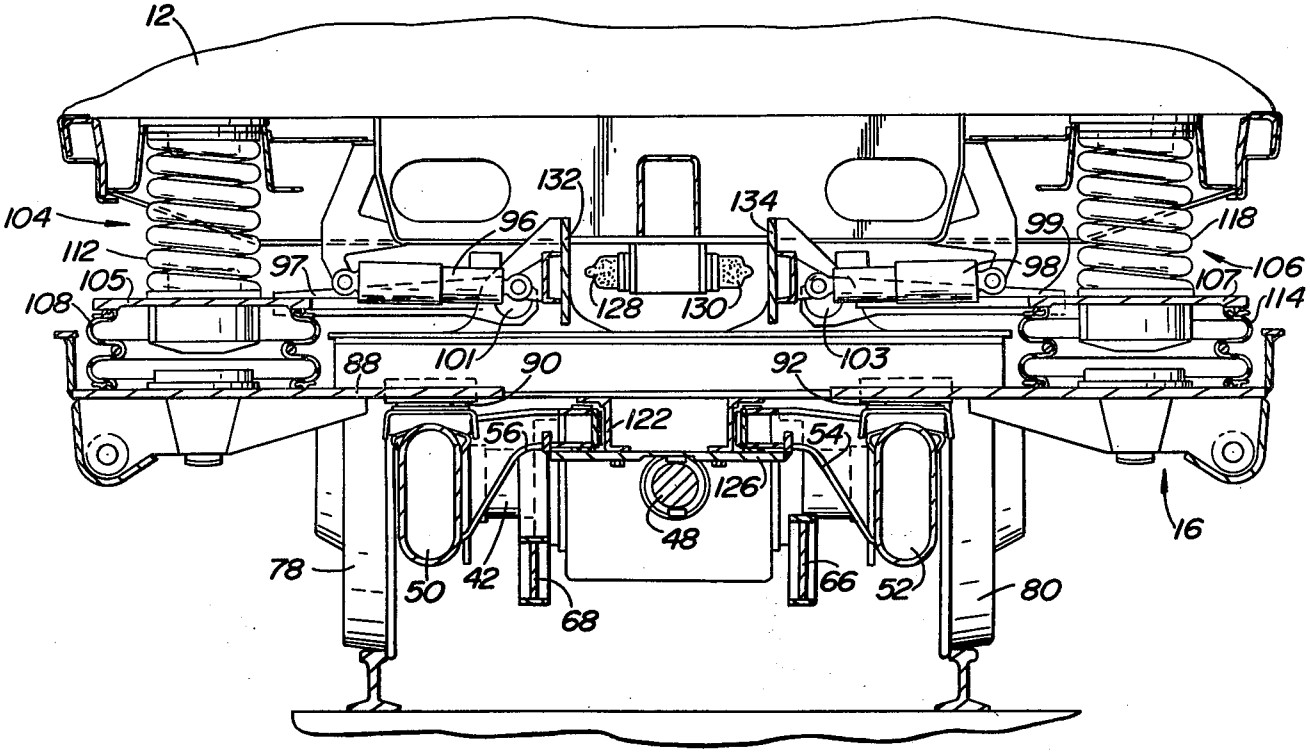
FIG. 4 is a view taken along line 4—4 of FIG. 3.
Figure 5:
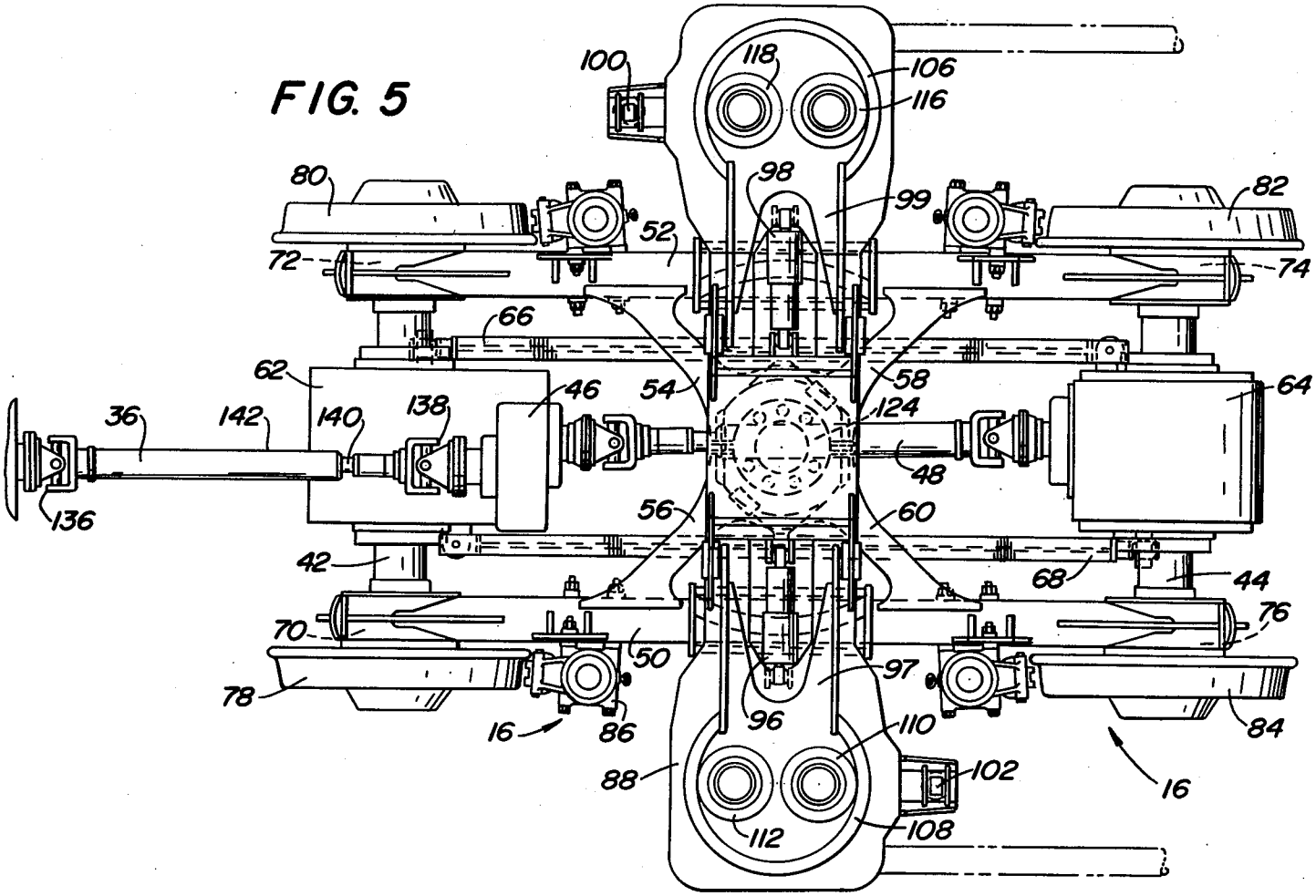
FIG. 5 is a top view of the truck with shock absorbers and mechanical springs illustrated in the previous figures.

Referring to FIGS. 3, 4 and 5, the truck 16 comprises a pair of side frames 50 and 52 having a spider-like structure extending therefrom including arms 54, 56, 58 and 60. A truck arrangement including a spider-like structure which has some of the features of the truck illustrated is described in a patent to W. B. Dean, U.S. Pat. No. 2,908,230, issued Oct. 13, 1959.

A pair of gear boxes 62 and 64 are mounted to the axles 42 and 44 and include the bevel gears 47 and 49 (FIG. 2) for driving the axles 42 and 44, respectively. The interchangeable gear mechanism 46 is connected to drive the bevel gears 47 within the gear box 62. In some case, the gear mechanism 46 may be included in the same box as the bevel gears 47.

A pair of torque arms 66 and 68 are connected between the gear boxes 62 and 64. The torque arms are required to take the reactions resulting from propulsion and engine braking loads.

The axles 42 and 44 are suitably mounted in bearings 70, 72, 74, 76 which are disposed at the ends of the side frames 50 and 52 in a conventional manner.

Wheels 78 and 80 are suitably mounted to the axle 42 and wheels 82 and 84 are mounted to the axle 44. Brake units, such as the brake unit 86, are mounted outboard and disposed to engage the wheels 78, 80, 82 and 84 during a braking operation.

A bolster 88 is supported transversely on the side frames 50 and 52. Slide bearings 90 and 92 are disposed between the bolster 88 and wear plates on the side frames 50 and 52, respectively. The slide bearings 90 and 92 permit the bolster 88 to be turnable or slideable with respect to the truck side frames 50 and 52 about relatively small angles during motion. The slide bearing arrangement is described in a copending application entitled "Side Bearers in a Railway Car", Ser. No. 867,668, filed Jan. 9, 1978 and assigned to the same assignee as the present invention.

Transverse or lateral shock absorbers 96 and 98, towards which the present invention is directed, is connected between the car body 94 and the bolster 88. Vertical shock absorbers 100 and 102 are also connected between the car body 94 and the bolster 88. The car body bottom structure 94 is supported on the bolster 88 by means of a pair of spring suspensions 104 and 106. The spring suspension 104 comprises an air spring 108 and a pair of mechanical springs 110 and 112 connected in series. The spring suspension 106 comprises an air spring 114 and a pair of mechanical springs 116 and 118 also serially connected.

The balanced lateral shock absorbers used in conjunction with the dual mechanical springs, are designed to have less resistances to shocks because of the relatively low lateral spring rates of the mechanical springs. Locations of the shock absorbers centrally along the longitudinal axis of the bolster provides an important advantage, especially in the event of failure of one of the shock absorbers. A single centrally disposed shock absorber will still provide the proper direction for absorbing lateral shocks.

With lower lateral spring rates in the mechanical springs, it is possible to use shock absorbers which are ligher and smaller physically. This results in more space for other components in areas of the trucks.

The use of a pair of dual mechanical springs 110, 112, 118 and 116 disposed longitudinally along axii parallel to the axii of the side frames 50 and 52 rather than single large mechanical springs provides a number of advantages. One of the more important advantages is the lower spring rate, which adds to the riding comfort of passengers in the car. For example, while no standards have been set, a lateral spring rate designed toward 1 Hz is desirable.

The dual mechanical spring arrangement permits easier lateral deflections not found in large diameter spring arrangements. At the same time, the stresses between the bolster and the mechanical springs are equally distributed. Further, a pair of smaller mechanical springs are lighter than a single mechanical spring designed to perform the same function.

It is noted that two or more springs arranged laterally will not produce the low lateral spring rate provided by having the springs arranged longitudinally, as illustrated. Also, the smaller springs make it possible to provide space for other components on the trucks.

A pair of spring planks 97 and 99 are pivoted on the bolster about pivot connections about pivot rods 101 and 103, respectively (FIG. 4). The planks 97 and 99 are connected to plates 105 and 107, respectively which are connected between the pairs of mechanical springs and the air springs. The planks are relatively stiff to accurately maintain the directions of deflections of the air springs in substantially vertical directions while the mechanical springs are deflected laterally. The use of relatively stiff or wide planks are especially important when relatively soft spring rates are involved in the mechanical springs, as in the present invention.

The bottom of the bolster 88 includes a center pin 122 mounted there to which is adapted to include a generally circular opening 124 provided at the ends of the arms 54, 56, 58 and 60. The center pin 122 is held in place by means of a plate member 126 bolted thereto.

A pair of lateral bumpers 128 and 130 are mounted to the bolster 88 to permit the lateral movement of the car body. Stop members 132 and 134 are connected to the car body to limit lateral movements of the car when they are contacted by either of the bumpers 128 and 130, respectively.

The shaft 36 is connected at one end to the driving means 20 through a flexible coupling 136. The other end of the shaft 36 is connected to the gear mechanism 46 through a flexible coupling 138. The shaft 36 may be of cardon type, which may include a spline arrangement to permit the element 140 to slide in and out of the exterior housing 142.

It is thus seen that the suspension system described provides for a relatively low lateral spring rate, with attendant reductions in the weights and sizes of the mechanical springs and shock absorbers. The stiff spring planks provide the control of the air spring with such low lateral spring rates.

What is claimed is:

1. A system for supporting a car body comprising:

(a) a truck assembly including a pair of longitudinally disposed parallel side frames, (b) an elongated bolster disposed transversely and supported by said side frames, (c) a pair of vertical mechanical springs disposed and spaced longitudinally with respect each side frame between said car body and said bolster towards each end of said bolster, (d) a pneumatic spring serially connected to each pair of said vertical mechanical springs, and (e) shock absorber means connected horizontally between said car body and said bolster and disposed along the longitudinal axis of said bolster.

2. A system as set forth in claim 1 wherein said shock absorber means comprises a pair of shock absorbers disposed along the longitudinal axis of said bolster on opposite sides of the center thereof.

3. A system as set forth in claim 2 wherein relatively wide members are pivotally connected at one end to said bolster and are connected at their opposite ends to elements disposed between said serially connected pairs of mechanical springs and said pneumatic springs to maintain the deflections of the pneumatic springs in vertical directions when said pairs of mechanical springs deflect laterally.

4. A system as set forth in claim 3 wherein each of said pairs of mechanical springs rest within the diameters of said pneumatic springs.

5. A system as set forth in claim 4 wherein lateral bumpers are connected to said car body and stop members are connected to said bolster to limit the lateral movements of said car body when either of said bumpers contact one of said stop members.

6. A system as set forth in claim 5 wherein said side frames include front and rear pairs of wheels with said side frames being disposed inboard of said wheels and said pairs of mechanical springs serially connected to said pneumatic springs are disposed outboard of said wheels.

7. A system as set forth in claim 6 wherein pairs of arms extend from each of said side frames to form a central opening to receive therethrough an attachment member from said bolster.

* * * * *